US006654988B1

(12) United States Patent
Chung

(10) Patent No.: US 6,654,988 B1
(45) Date of Patent: Dec. 2, 2003

(54) STOPPABLE ZIPPER SLIDER CAPABLE OF BEING REASSEMBLED WITH PULL TAB

(76) Inventor: Roger C. Y. Chung, 2F, No. 1, Alley 3, Lane 106, Lung-An Rd., Hsinchung City, Taipei Hsien (TW)

( * ) Notice: Subject to any disclaimer, the term of this patent is extended or adjusted under 35 U.S.C. 154(b) by 0 days.

(21) Appl. No.: 10/303,792

(22) Filed: Nov. 26, 2002

(51) Int. Cl.[7] ..... A44B 19/30

(52) U.S. Cl. ..... 24/421; 24/419; 24/429; 24/424; 24/425

(58) Field of Search ..... 24/421, 419, 429, 24/420, 424, 425, 430, 436, 437; 294/3.6; 70/68

(56) References Cited

U.S. PATENT DOCUMENTS 3,813,736 A * 6/1974 Fukuroi ..... 24/421
4,102,022 A * 7/1978 Aoki ..... 24/429
4,287,646 A * 9/1981 Kanzaka ..... 24/419
5,625,928 A * 5/1997 Terada et al. ..... 24/424
5,729,874 A * 3/1998 Mizuno ..... 24/429

* cited by examiner

*Primary Examiner*—Victor Sakran
(74) *Attorney, Agent, or Firm*—Bacon & Thomas, PLLC

(57) ABSTRACT

A stoppable zipper slider is mainly a set of sustaining leaf springs, consisting of a single or a pair of pieces, on the inner surface of the covering portion of the zipper slider. The set of sustaining leaf springs, of single piece or two pieces, with one end sustaining downward against the top surface of a stopping hook piece and the other end propping up in between the tail of the hook piece and the slider body, enable a pull tab's sliding along a reserved gap within the covering portion and propping the bottom of one leaf spring open and then entering a braking notch of the stopping hook piece so as to accomplish the action of re-assembly.

9 Claims, 13 Drawing Sheets

STOPPABLE ZIPPER SLIDER CAPABLE OF BEING REASSEMBLED WITH PULL TAB

BACKGROUND OF THE INVENTION (a) Field of the Invention

The present invention relates to a stoppable zipper slider, wherein a pull tab can be re-assembled thereto, and more particularly to a zipper slider providing re-assembly of a pull tab to satisfy the necessity of changing to another non-specific pull tab.

(b) Description of the Prior Art

Conventional zipper sliders can be classified into two types, stoppable ones and non-stoppable ones. Non-stoppable zipper sliders are in widespread use in the art. Without the function of stopping motions, a zipper slider is likely to run away unexpectedly. Stoppable zipper sliders have a stopping hook piece (so-called a horse hook) embedded within the slider body. Since a post of the stopping hook piece can insert between in the teeth of a zipper while the zipper slider is moving thereabout, the zipper slider is stopped after being positioned at a location, and therefore unexpected runaway of a zipper can be avoided. This type of zipper sliders can be applied to both visible and invisible zippers. The conventional design uses a sustaining leaf spring install inside the covering portion of a zipper slider. By propping up the stopping hook piece by the downward sustaining leaf spring, the post of the stopping hook piece can insert between the teeth of a zipper accordingly so that the zipper slider is in a stabilized state. By pulling the pull tab of a zipper slider, the post of the stopping hook piece is driven to depart from the teeth so that a free control of zipper movement is enabled.

The above-mentioned stoppable zipper sliders must be fabricated in one sequence by which a stopping hook piece, sustaining leaf spring(s) and pull tab are simultaneously pre-installed within a covering portion and then sealed. Therefore, the slider body and the pull tab of the conventional stoppable zipper sliders are inseparable. That is, replacing the pull tab in a later fabrication sequence is out of the question. Restricted by fabrication in one sequence, a pull tab's shape, appearance, brand name, label, color and style cannot be changed subject to different needs, hence it is very inconvenient for both the manufacturers of zipper sliders and the downstream industries.

SUMMARY OF THE INVENTION

It is an object of the present invention to provide a design of a braking zipper slider capable of a pull tab being reinstalled. That is, a braking zipper slider can be composed in advance and provides the flexibility of a secondary installation of a pull tab at a later time. Therefore, downstream industries can select an arbitrary pull tab for installation as needed, free from the limitation of fabrication in one sequence.

It is an secondary object of the present invention to provide a design of a braking zipper slider capable of a pull tab being reinstalled, wherein a set of sustaining leaf springs, consisting of a single or a pair of pieces, are embedded on the inner surface of the covering portion of the zipper slider; one end of the sustaining leaf spring(s) sustains downward against the upper surface of a stopping hook piece, and the other end sustains between the tail of the hook piece and the slider body. With such a design, a pull tab's can slide along a gap within the covering portion, prop the bottom end of the second leaf spring open and then enter a braking notch of the stopping hook piece so as to accomplish the action of reinstallation.

DETAILED DESCRIPTION OF THE PREFERRED EMBODIMENTS

Figure 1:
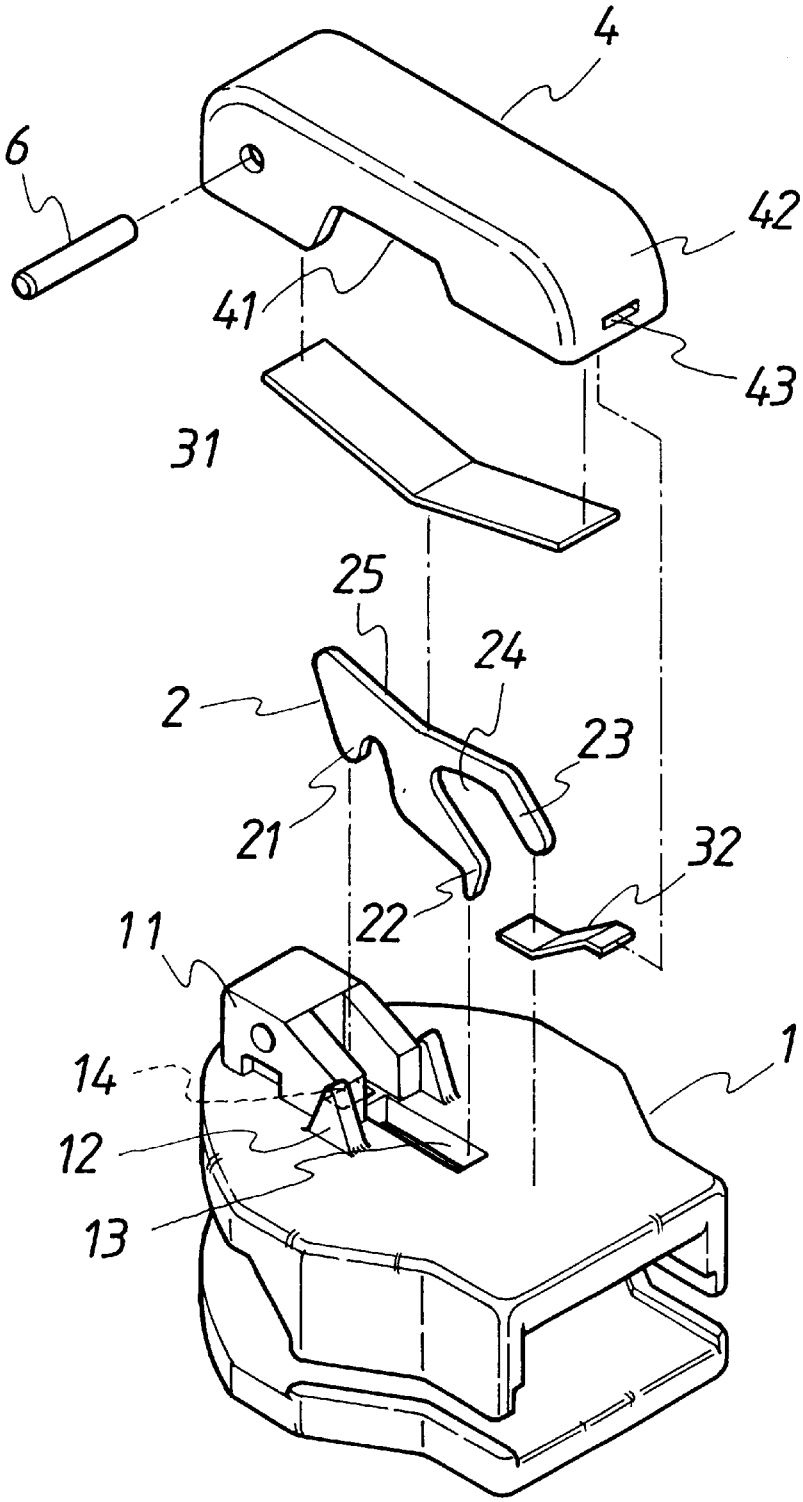
FIG. 1 is an exploded view of the first embodiment of the present invention.
Figure 2:
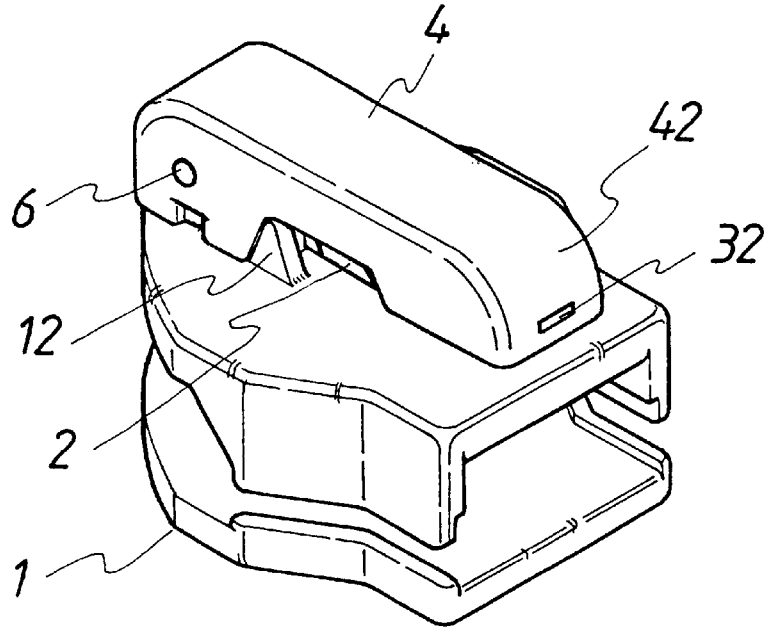
FIG. 2 is an edge view with all components assembled of the first embodiment of the present invention.
Figure 3:
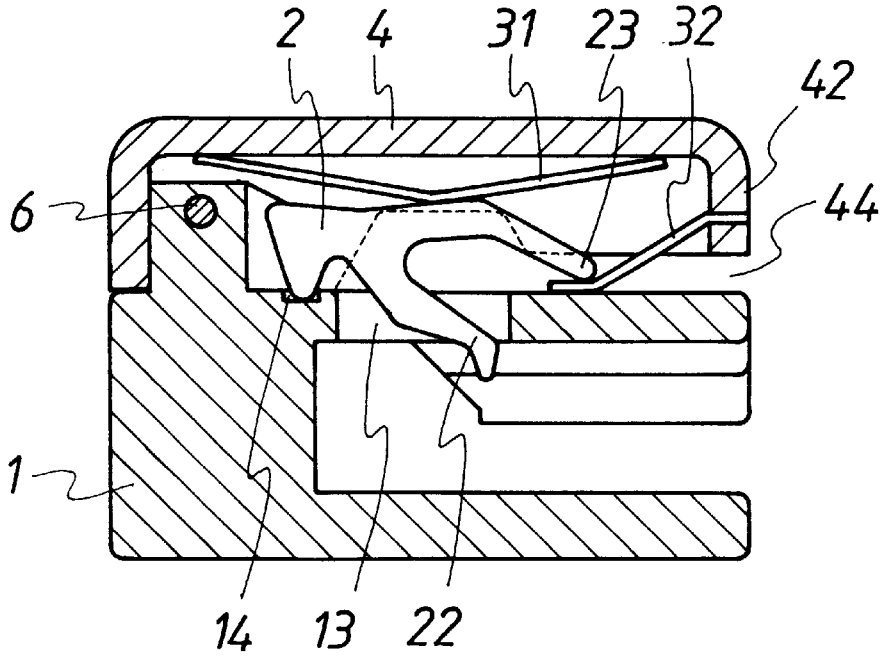
FIG. 3 is an assembled cross sectional view of the first embodiment of the present invention.
Figure 6:
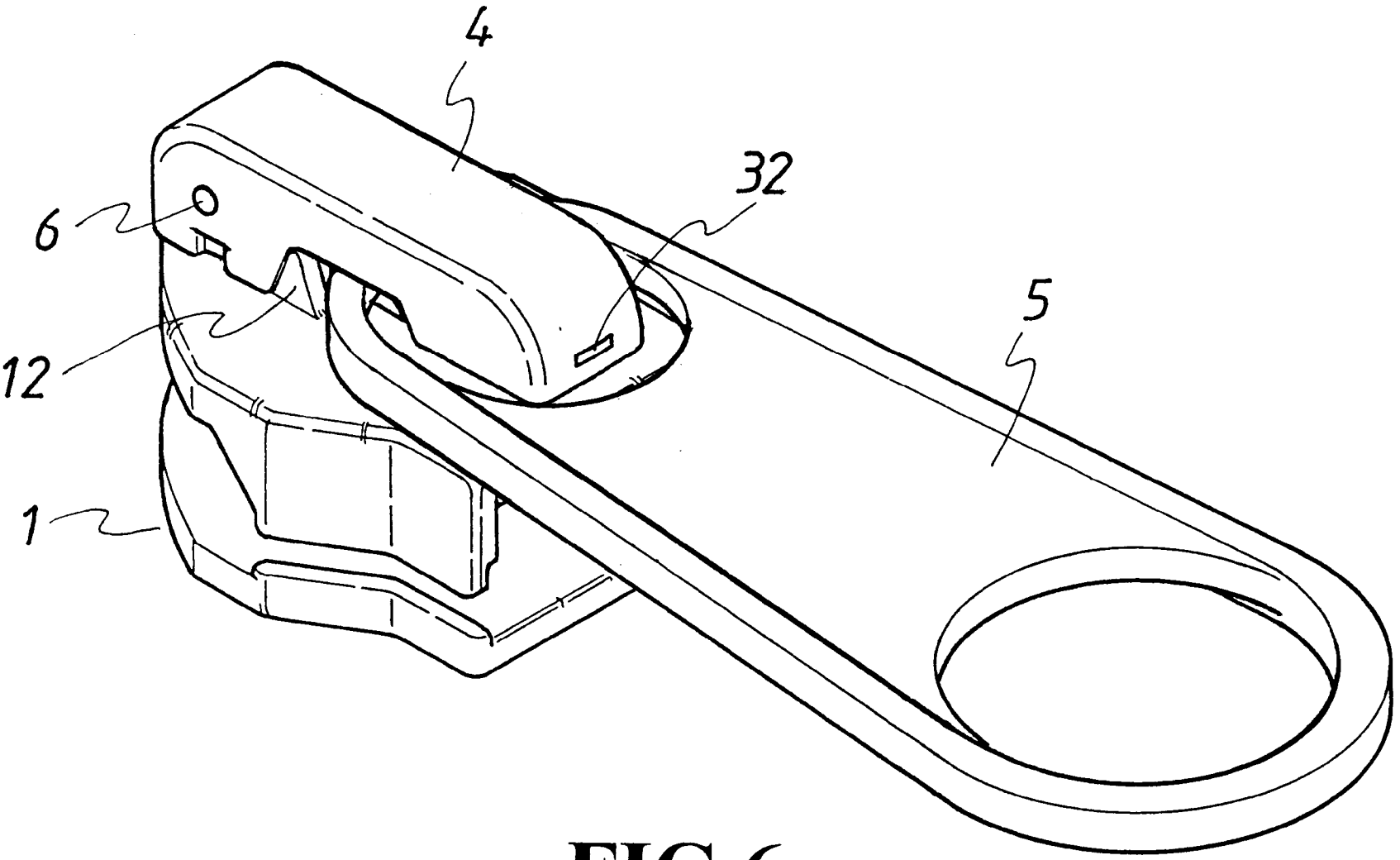
FIG. 6 is an exploded edge view of a replaceable pull tab embedded in the first embodiment of the present invention.

As shown in FIGS. 1 3, the present invention is related to a "stoppable zipper slider capable of being reassembled with a pull tab" that includes a slider body 1, a stopping hooking piece 2, a set of sustaining leaf springs 31,32, and a covering portion. Working together with a pull tab 5, they constitute a stoppable zipper slider (as shown in FIG. 6).

A slider body 1 is slidably mounted to the zipper for movement between a closed position and an open position, having an inserting section 11 formed on the top surface thereof and blocks 12 molded on both sides of the inserting section 11 for embedding a covering portion 4. On one side of the inserting section an aperture 13 is chiseled for embedding a stopping hook piece 2. At a corresponding location, a groove 14 is formed for the hook head 21 of the stopping hook piece 12 to insert thereinto and be held in a fixed position.

A stopping hook piece 2 having a hook head 21, a post 22 and a hook tail 23 forms a braking notch 24 between the post 22 and the hook tail 23. The stopping hook piece 2 is inserted in the aperture 13 of the slider body 1, with the hook head 21 aligned with the groove 14, the post 22 settled within the aperture 13, and the hook tail 23 propping against a sustaining leaf spring 32.

A set of sustaining leaf springs 31,32 consists of a first leaf spring and a second leaf spring. The first leaf spring 31, being V or U shaped and embedded on a inner wall within the covering portion 4, sustains downward against the top surface 25 of the stopping hook piece 2. The second leaf spring 32 has one end embedded on the inner wall within the covering portion 4 and the other end sustaining against between the hook tail 23 of the stopping hook piece 2 and the slider body 1.

A covering portion 4, being a hallow shell, has a recess 41 underneath the middle section thereof. The front section of the covering section is mounted firmly on the inserting section 11 and blocks 12 of the slider body 1 by pivoting or riveting. There is a slot 43 formed at the rear end for the insertion of one end of the second leaf spring 32. Moreover, there reserves a gap 44 in between the bottom of the rear section 42 and the slider body 1, as shown in FIG. 3.

Figure 5:
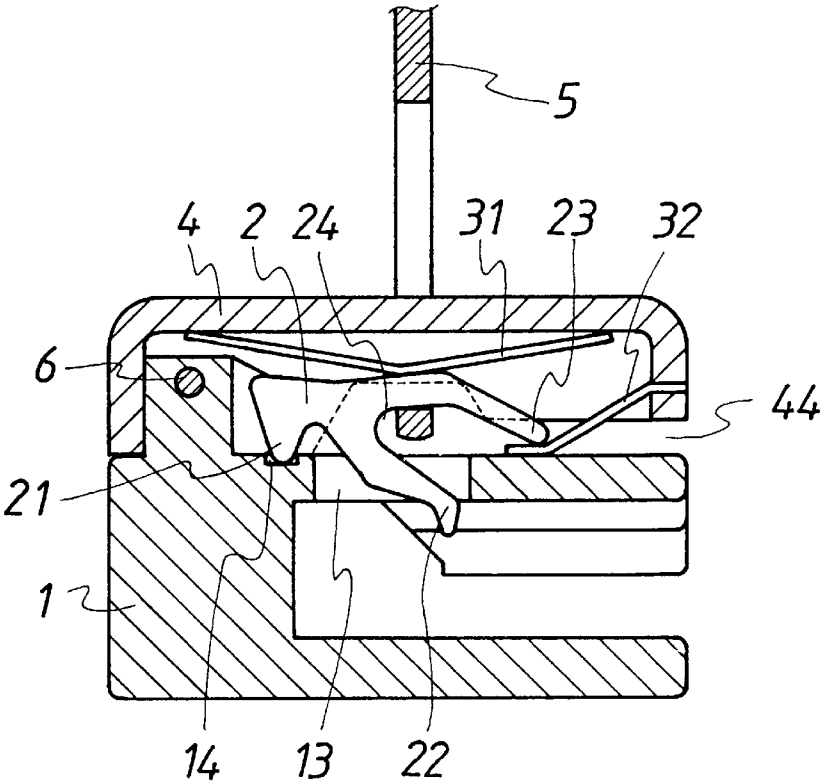
FIG. 5 is a diagram that illustrates a replaceable pull tab embedded in the first embodiment of the present invention.
Figure 4:
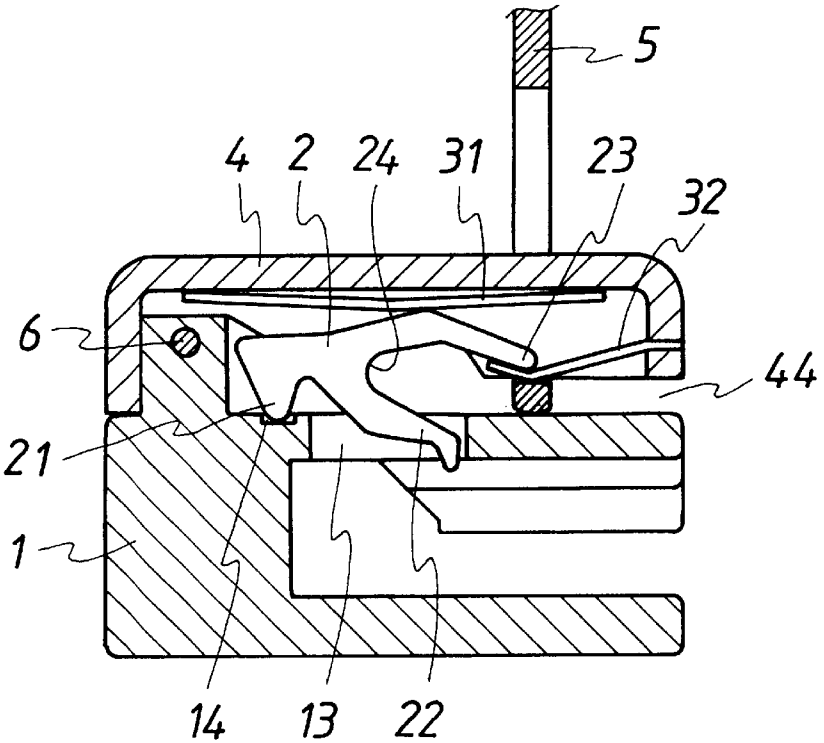
FIG. 4 is a diagram that illustrates a pull tab being inserted in the first embodiment of the present invention.

A pull tab 5, as shown in FIGS. 4 and 5, gets into the braking notch 24 by pushing open the second leaf spring 32 along the reserved gap 44 of the covering portion 4. After the pull tab 5 gets in, the second leaf spring 32 restores its original sustaining status so as to seal the pull tab 5 in the reserved gap 44, completing the action of reinstallation (as shown in FIG. 6).

Figure 7:
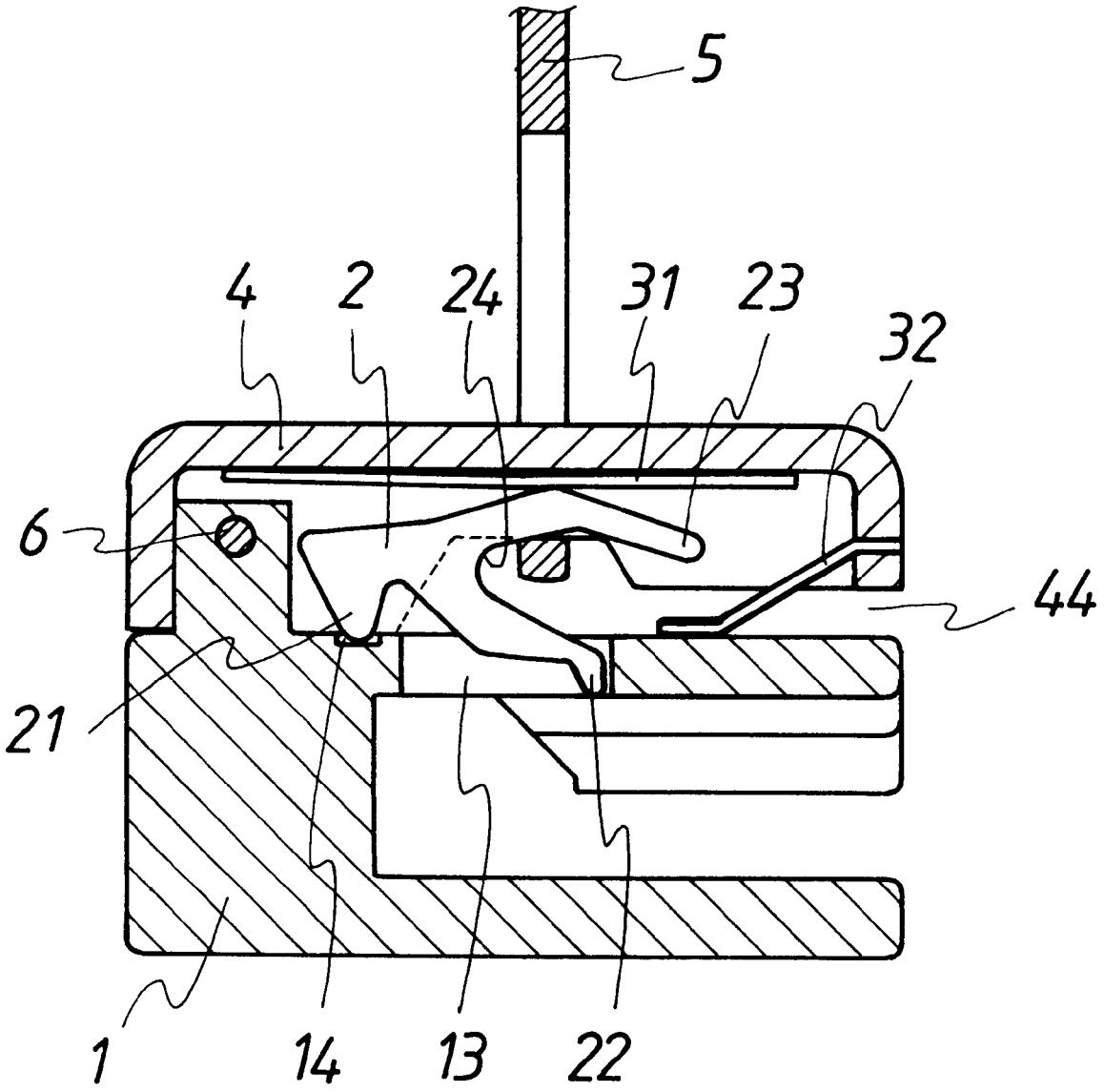
FIG. 7 is a diagram showing the state of the pull tab being pulled in the first embodiment of the present invention.

According to the "Braking Zipper Slider Capable of A Pull Tab Being Reassembled" as realized by the present invention, prior to the pull tab being pulled (as shown in FIG. 5), the post 22 of the stopping hook piece 2 prop up against the teeth of the zipper, and therefore the slider body 1 is held in a fixed position. When the pull tab 5 is pulled (as shown in FIG. 7), the stopping hook piece 2 is lifted up and the post 22 thereof departs from the teeth, and therefore the slider body 1 returns to the sliding state, by which a free control of zipper slider movement is enabled.

Figure 8:
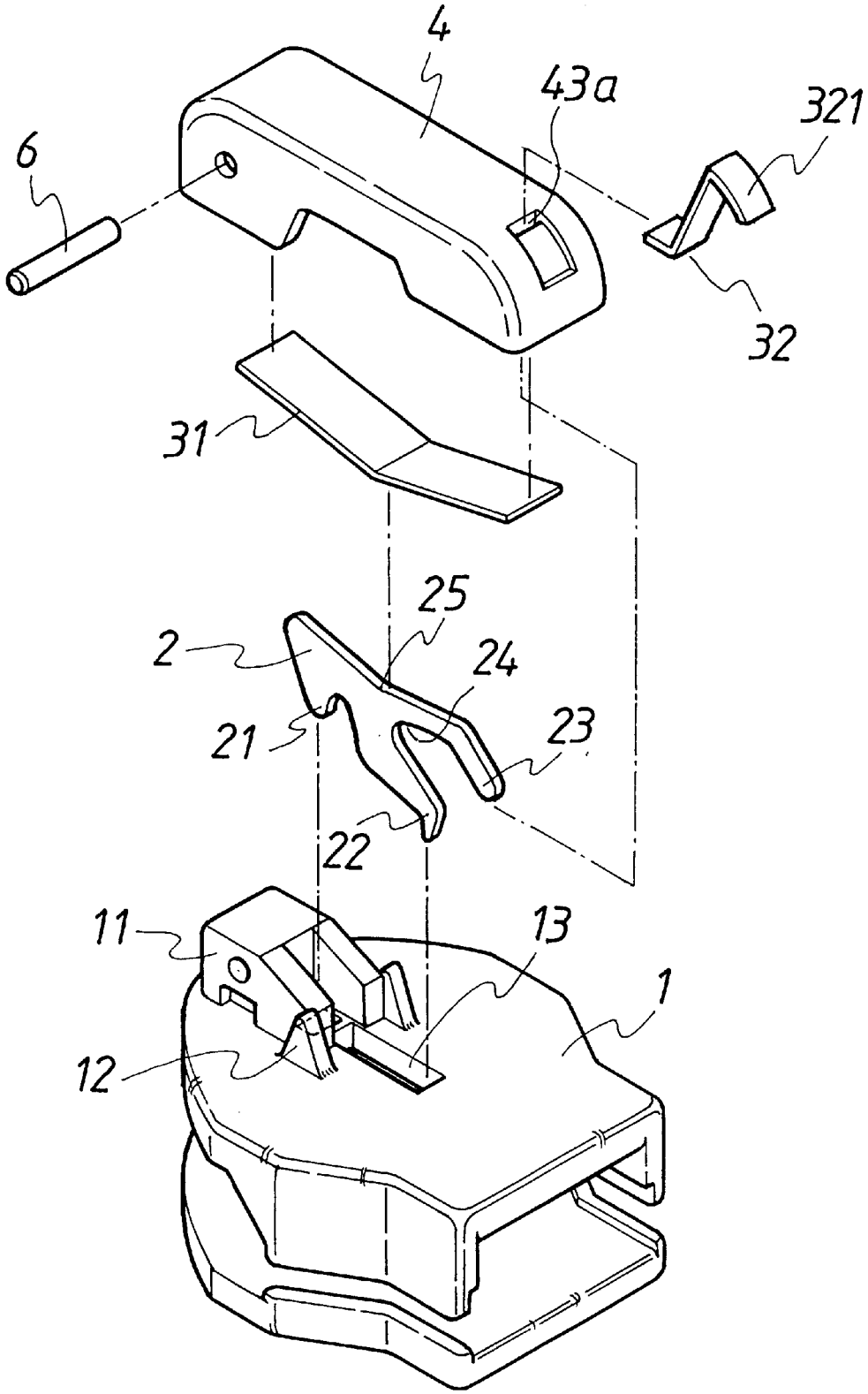
FIG. 8 is an exploded edge view of the first embodiment of the present invention.
Figure 9:
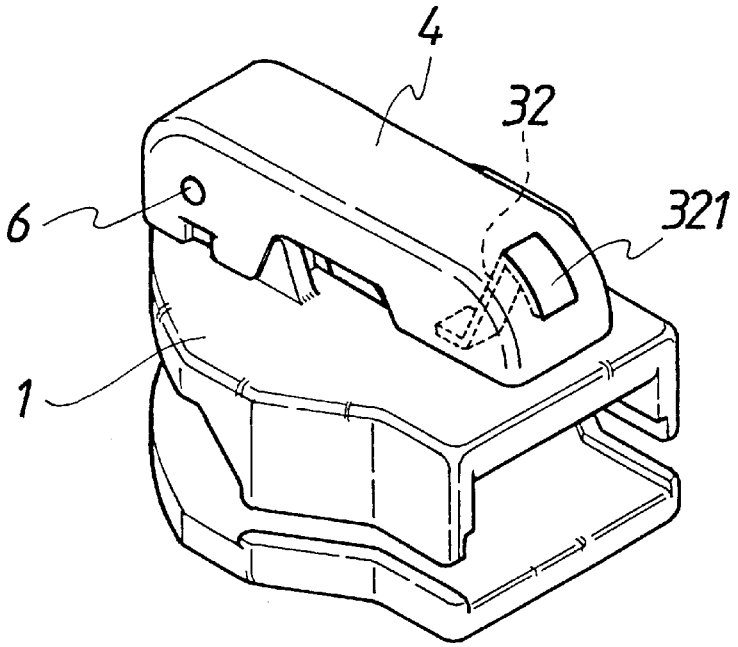
FIG. 9 is an edge view with all components assembled of the second embodiment of the present invention.
Figure 10:
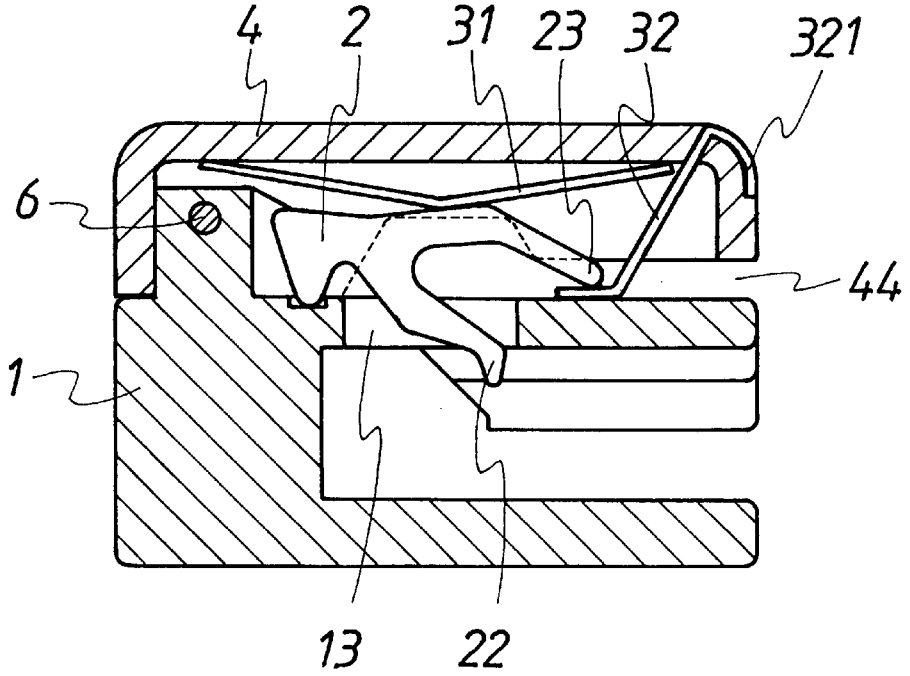
FIG. 10 is an assembled cross sectional view of the second embodiment of the present invention.

FIG. 8 and FIG. 10 illustrate another embodiment of this present invention in which the inserting configuration of the second leaf spring 32 in the covering portion 4 is modified slightly. The new configuration contains an end piece 321 added to the end of the second leaf spring 32 and the a slot 43*a* formed in the rear section 42 of the covering portion 4 for embedding the end piece 321 of the second leaf spring 32. Therefore, the rear end piece 321 can protrude and conceal closely in the corresponding slot 43*a* in the rear section 42 of the covering portion 4 to obtain a better effect of fix-position linkage.

Figure 11:
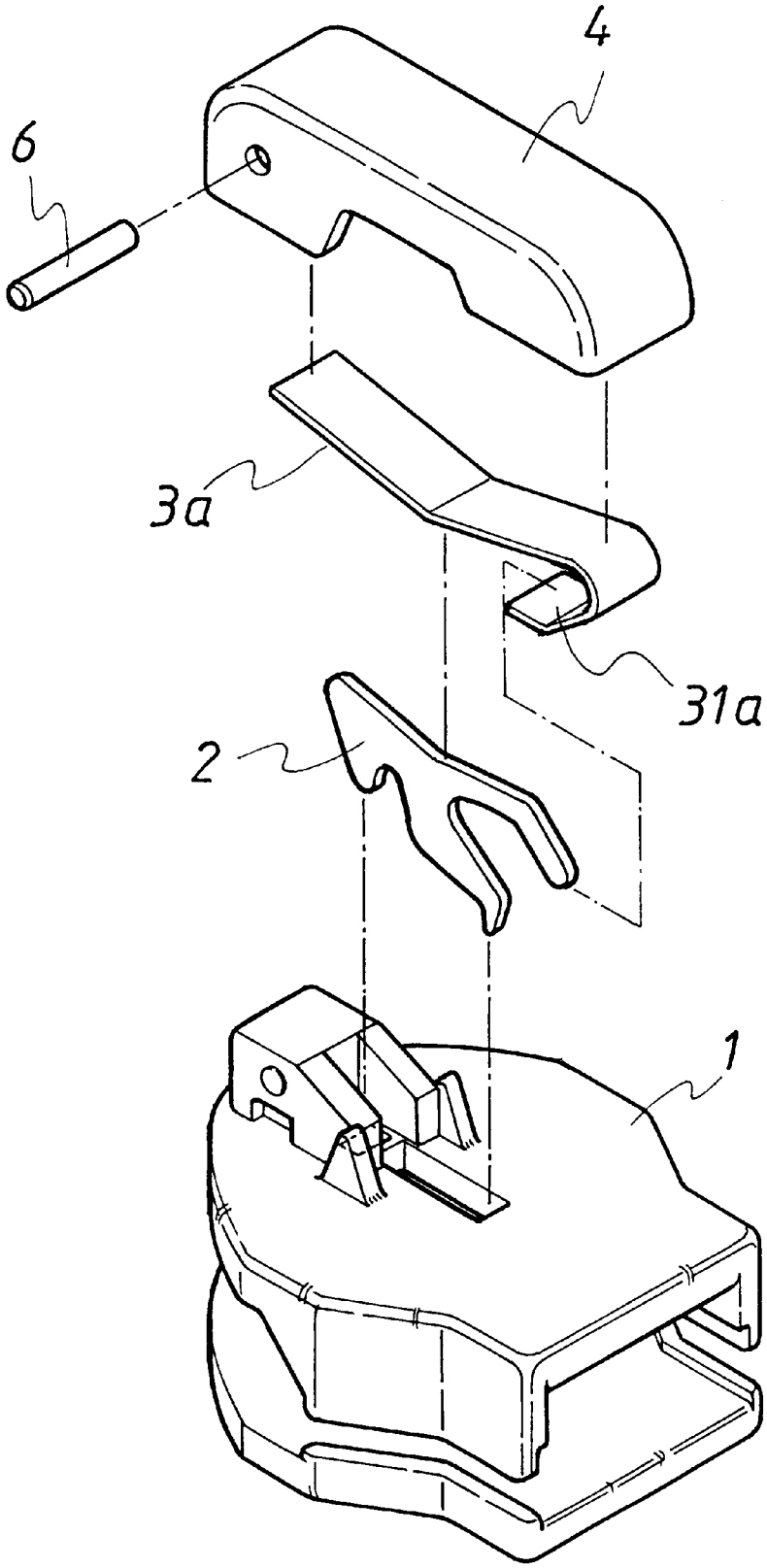
FIG. 11 is an exploded edge view with all components disassembled of the third embodiment of the present invention.
Figure 12:
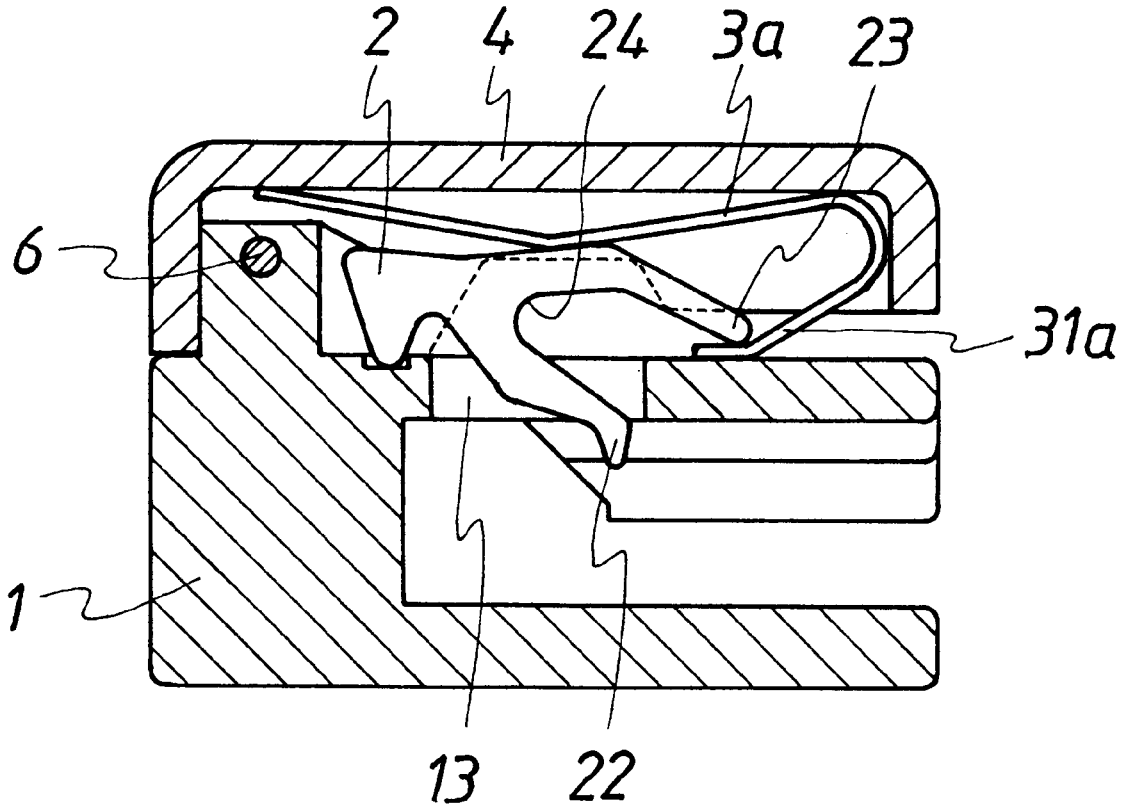
FIG. 12 is a cross sectional view with all components assembled of the second embodiment of the present invention.

Except for the embodiment of the configuration of double sustaining leaf springs, namely, the first sustaining leaf spring 31 and the second sustaining leaf spring 32, a configuration of single sustaining leaf spring 3*a* can be applied as well if necessary, as shown in FIG. 11 and FIG. 12. One end of the single leaf spring 3*a* is V or U shaped and sustains downward against the top surface 25 of the stopping hook piece 2. The other end of the single leaf spring 3*a* extends crookedly to sustain against in between the hook tail 23 of the stopping hook piece 2 and the slider body 1, so that the pull tab 5 can get into the braking notch 24 through the reserved gap 44 of the covering portion 4 by pushing open the other end 31*a* of the sustaining leaf spring 3*a*, and therefore a re-assembly is accomplished.

Figure 13:
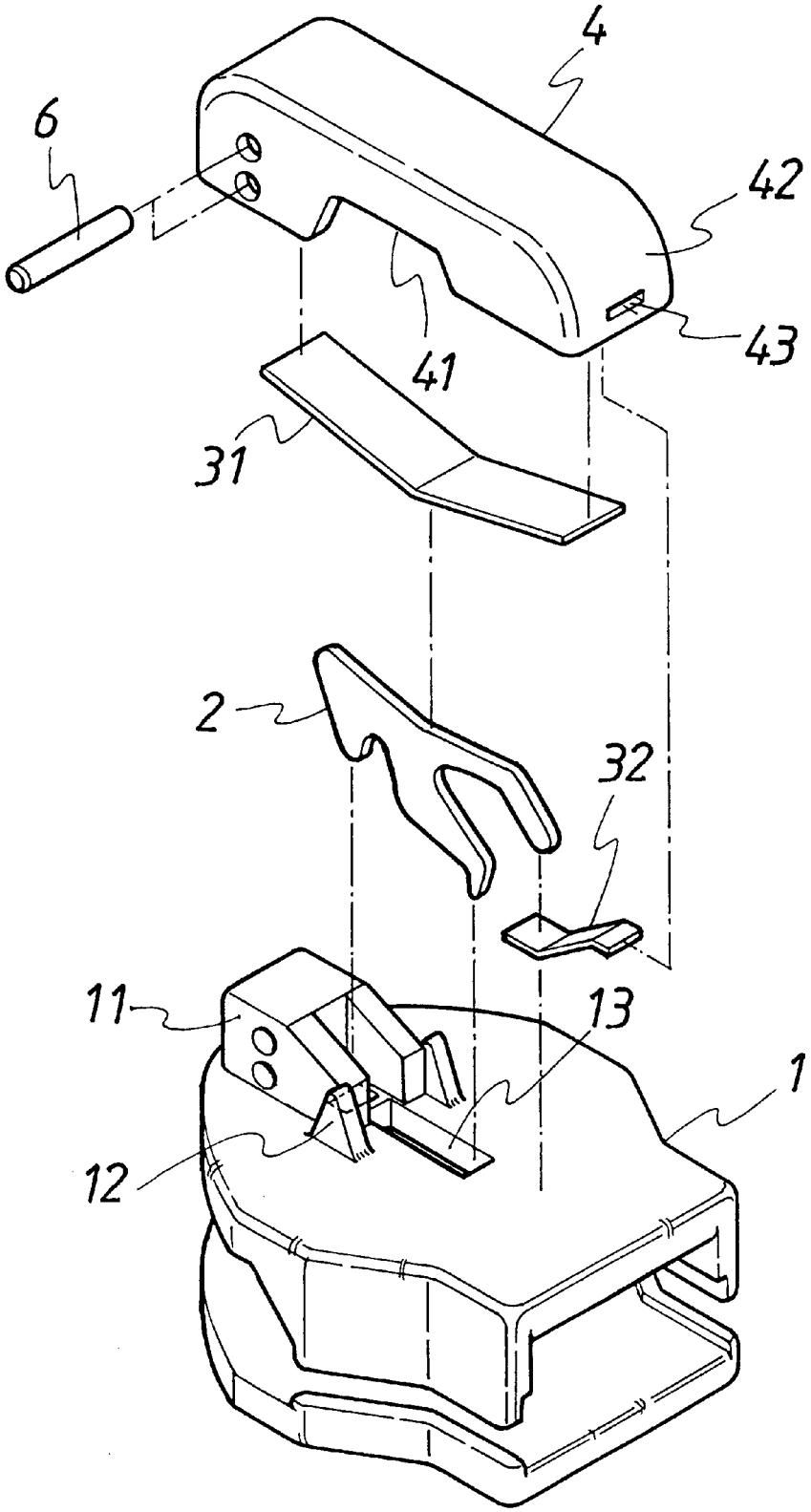
FIG. 13 illustrates the embodiment of the fixing and integration of the covering portion and the inserting section by two pivoting pins piercing through them.
Figure 14:
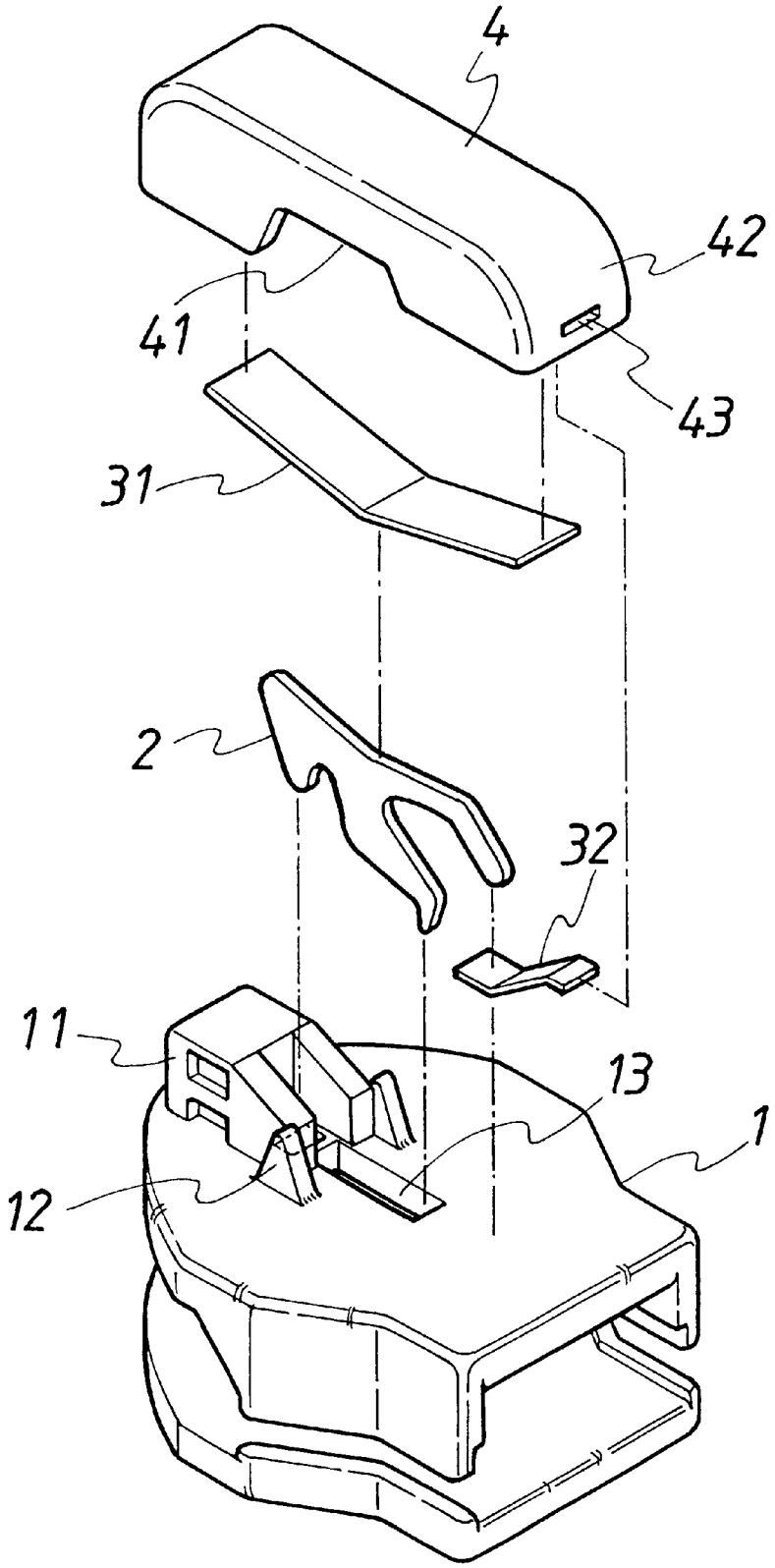
FIG. 14 illustrates the embodiment of applying double riveting to integrate the covering portion and the inserting section.
Figure 15:
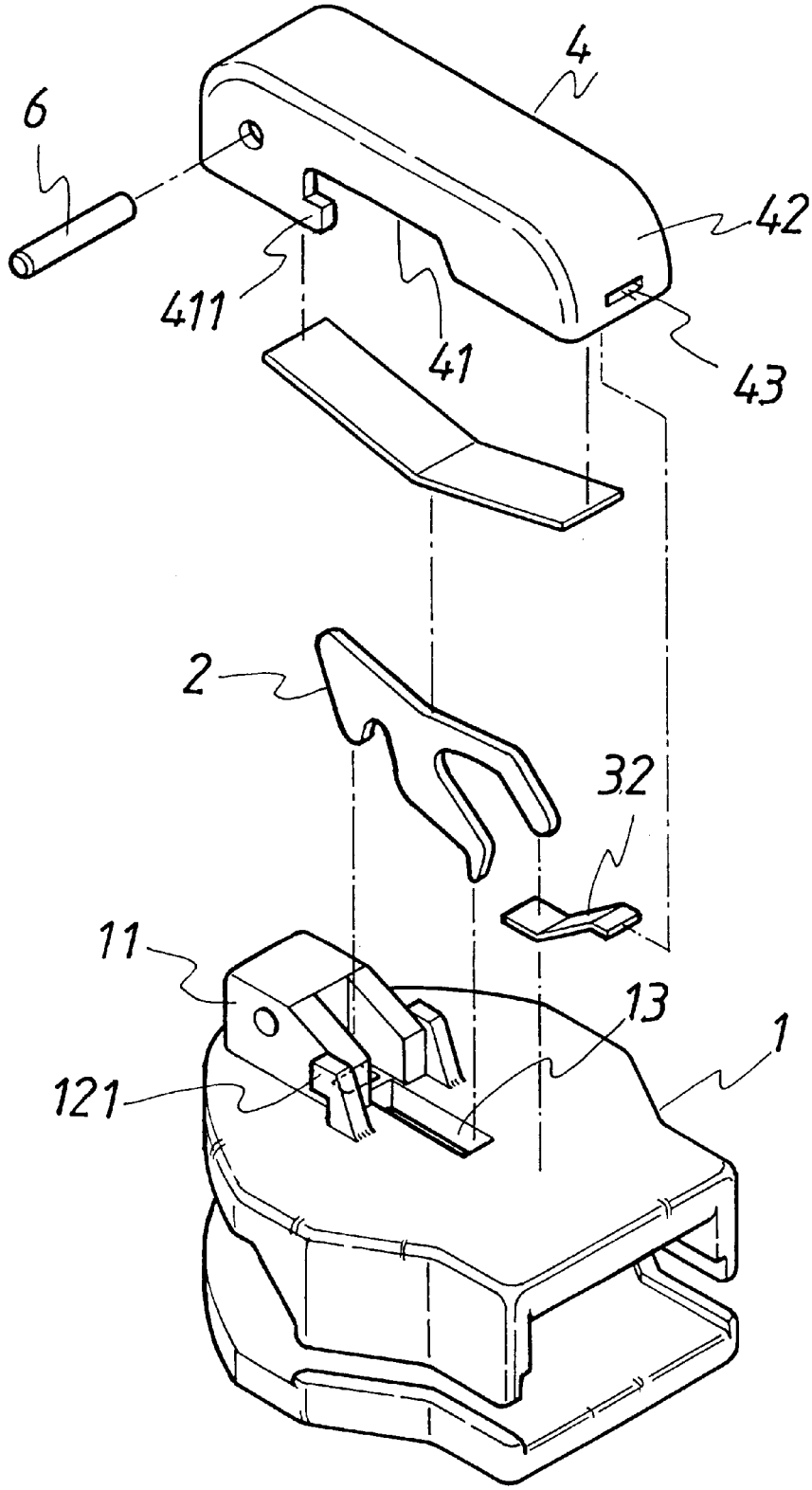
FIG. 15 illustrates the embodiment of adding corresponding inserting pieces to the covering portion and the inserting section.
Figure 16:
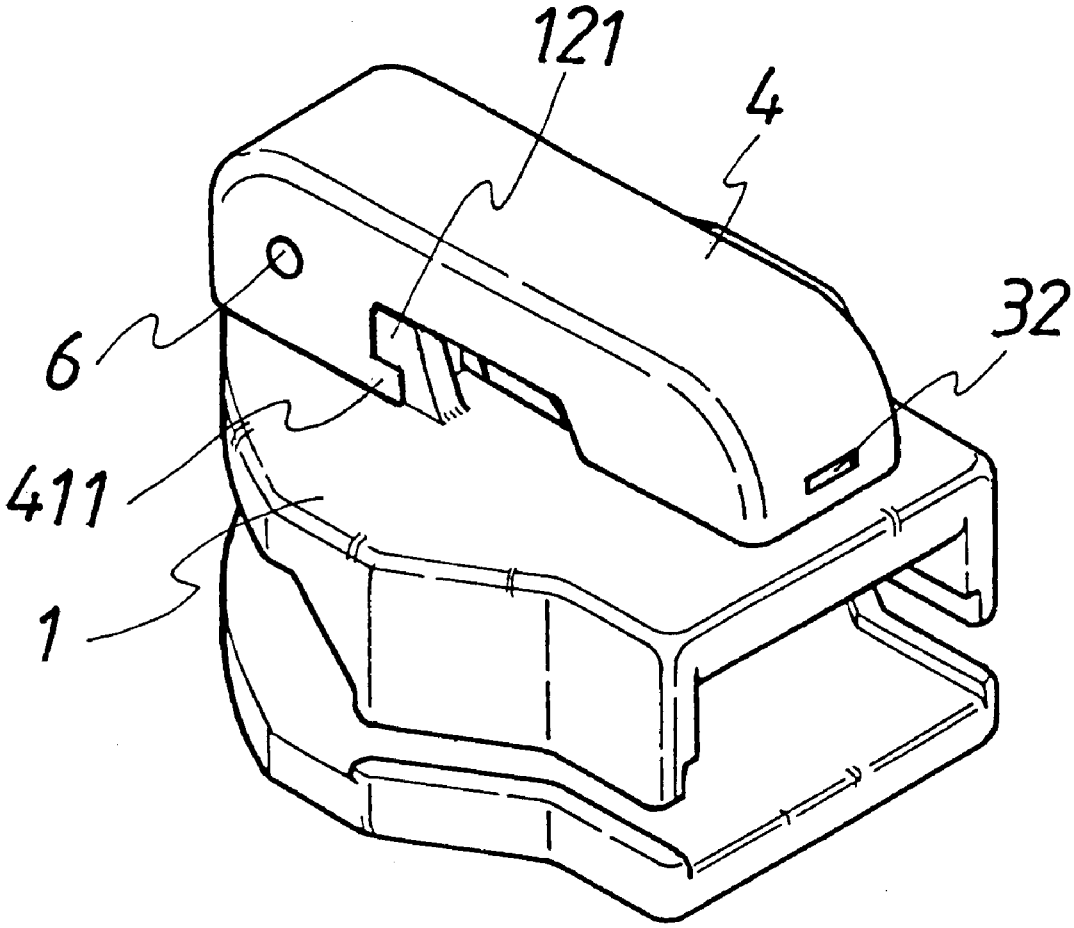
FIG. 16 is an edge view with all components in FIG. 15 assembled.

The integration of the covering portion 4 and the slider body 1 mentioned above is for combining the covering portion 4 with the slider body 1 firmly. There is no particular restriction on the means used. As the above-mentioned embodiments had shown, the covering portion 4 and the inserting section 11 can be firmly integrated by a pivoting pin 6 passing through the covering portion 4 and the inserting section 11. Also, either by using two pivot pins 6 passing through the covering portion 4 and the inserting section 11 simultaneously and have them pivoted at a fixed position as FIG. 13 illustrates, or by applying riveting twice to securely combine them as FIG. 14 illustrates. Moreover, as FIG. 15 illustrates, by establishing inlay chunks 411,121 correspondently with blocks 12 at one side of the recess 41 at the lower part of the covering portion 4 and have them pivoted at a fixed position by using a pivoting pin 6 passing through the covering portion 4 and the inserting section 11 (Riveting can be applied as well), they can be equally securely combined.

To summarize the above points, it is obvious that, because of the capability of re-assembling a pull tab, the shape or type of the pull tab can be chosen in accordance with the need of downstream manufacturers, and therefore this design of "A Stoppable Zipper Slider Capable of A Pull Tab Being Re-assembled" is provided with novelty and practicality.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A stoppable zipper slider capable of being reassembled with a pull tab comprising:

a slider body having an aperture formed on a top surface thereof;

a stopping hook piece embedded in said aperture of the slider aperture; and a covering portion inserted on a top surface of said slider body;

said stopping hook piece having a head, a post and a tail, wherein a braking notch is formed between said post and said tail;

a set of sustaining leaf springs comprising a primary leaf spring, embedded on an inner wall of said covering portion, sustaining against a top surface of said stopping hook piece and a secondary leaf spring, with one end inserted on an inner wall of said covering portion and the other end sustaining between said tail of said stopping hook piece and said slider body; and said covering portion having a middle section and a recess is formed under said middle section, a front section mounted at said slider body, and a rear section with a slot opened for inserting said one end of said secondary leaf spring; and a gap reserved between a bottom of said rear section and said slider body.

2. The stoppable zipper slider capable of being reassembled with a pull tab of claim 1, wherein a pull tab slides along said gap of said covering portion, props a bottom of said secondary leaf spring open and then enters said braking notch of said stopping hook piece.

3. The stoppable zipper slider capable of being reassembled with a pull tab of claim 1, wherein an end piece is formed at one end of said secondary leaf spring and said slot for being inserted by said end piece is opened at said rear section of said covering portion.

4. The stoppable zipper slider capable of being reassembled with a pull tab of claim 1, wherein an inserting section and a pair of blocks are formed on a top surface of said slider body for embedding said covering portion.

5. The stoppable zipper slider capable of being reassembled with a pull tab of claim 1 wherein a groove is formed on a selected location on said slider body for being embedded by said head of said stopping hook piece.

6. The stoppable zipper slider capable of being reassembled with a pull tab of claim 1, wherein a shape of said primary leaf spring is one of U shapes and U shapes.

7. The stoppable zipper slider capable of being reassembled with a pull tab of claim 1, wherein said covering portion is a hallow shell, with said front portion embedded in said slider body by a way selected one of pivoting and riveting.

8. A stoppable zipper slider capable of being reassembled with a pull tab comprising:

a slider body having an aperture formed on a top surface thereof;

a stopping hook piece embedded in said aperture of the slider aperture;

a single sustaining leaf spring; and a covering portion inserted on a top surface of said slider body;

said stopping hook piece having a head, a post and a tail, wherein a braking notch is formed between said post and said tail;

said single sustaining leaf spring having one end sustaining downward against said top surface of said stopping hook piece and the other end extending crookedly and sustaining between said tail of said stopping hook piece and said slider body; and said covering portion having a middle section, and a recess is formed thereunder, a front section mounted at said slider body, and a rear section with a slot opened for inserting said one end of said single sustaining leaf spring; a gap reserved between a bottom of said rear section and said slider body.

9. The stoppable zipper slider capable of being reassembled with a pull tab of claim 8 wherein a pull tab slides along said gap of said covering portion, props an end of said single sustaining leaf spring open and then enters said braking notch of said stopping hook piece.

* * * * *